US005257937A

United States Patent [19]

Bousquet et al.

[11] Patent Number: 5,257,937

[45] Date of Patent: Nov. 2, 1993

[54] TRAINING SIMULATOR FOR THE SHOULDER FIRING OF MISSILES

[75] Inventors: Jean-Claude Bousquet, Bourges; Bernard Maupetit, Savigny en Septaine; Christiane Renon, Bourges; Jean-Luc Marceau, Le Subdray, all of France

[73] Assignee: Aerospatiale Societe Nationale Industrielle, Paris, France

[21] Appl. No.: 987,714

[22] Filed: Dec. 8, 1992

[30] Foreign Application Priority Data

Dec. 20, 1991 [FR] France ..... 91 15889

[51] Int. Cl.[5] ..... F41A 33/06

[52] U.S. Cl. ..... 434/18; 434/16

[58] Field of Search ..... 434/16, 18

[56] References Cited

U.S. PATENT DOCUMENTS

| | | | |
|---|---|---|---|
| H186 | 1/1987 | Marshall et al. | 484/18 |
| 2,342,684 | 2/1944 | Nelson | 434/16 |
| 4,050,166 | 9/1977 | Swiatosz et al. | 434/18 |
| 4,079,525 | 3/1978 | Linton et al. | 434/18 |
| 4,321,043 | 3/1982 | Grimmer et al. | 434/18 |
| 4,447,221 | 5/1984 | Mulzet | 494/45 |
| 4,480,999 | 11/1984 | Wetherell et al. | 434/18 |
| 4,591,342 | 5/1986 | Lipp | 434/18 |
| 4,605,372 | 8/1986 | Nyzell | 434/16 |
| 4,654,008 | 3/1987 | Elmore | 434/16 |

FOREIGN PATENT DOCUMENTS

| | | | |
|---|---|---|---|
| 710063 | 1/1980 | U.S.S.R. | 434/18 |

*Primary Examiner*—Gene Mancene
*Assistant Examiner*—L. Thomas
*Attorney, Agent, or Firm*—Finnegan, Henderson, Farabow, Garrett & Dunner

[57] ABSTRACT

For training persons having to fire missiles from the shoulder, a simulator is proposed which comprises a simulated launch or firing tube (10), which carries a front, releasable or jettisonable mass (12) and a rear releasable or jettisonable mass (14) at its ends. These masses are held by electromagnets (34, 36). When the person firing or firer presses the trigger (18), the rear mass (14) is ejected to the left followed, with a time lag ($\Delta t$), by the front mass (12). Thus, the load relief and site and bearing movements felt by the firer during a real launch are restored.

8 Claims, 2 Drawing Sheets

TRAINING SIMULATOR FOR THE SHOULDER FIRING OF MISSILES

DESCRIPTION

Figure 1:
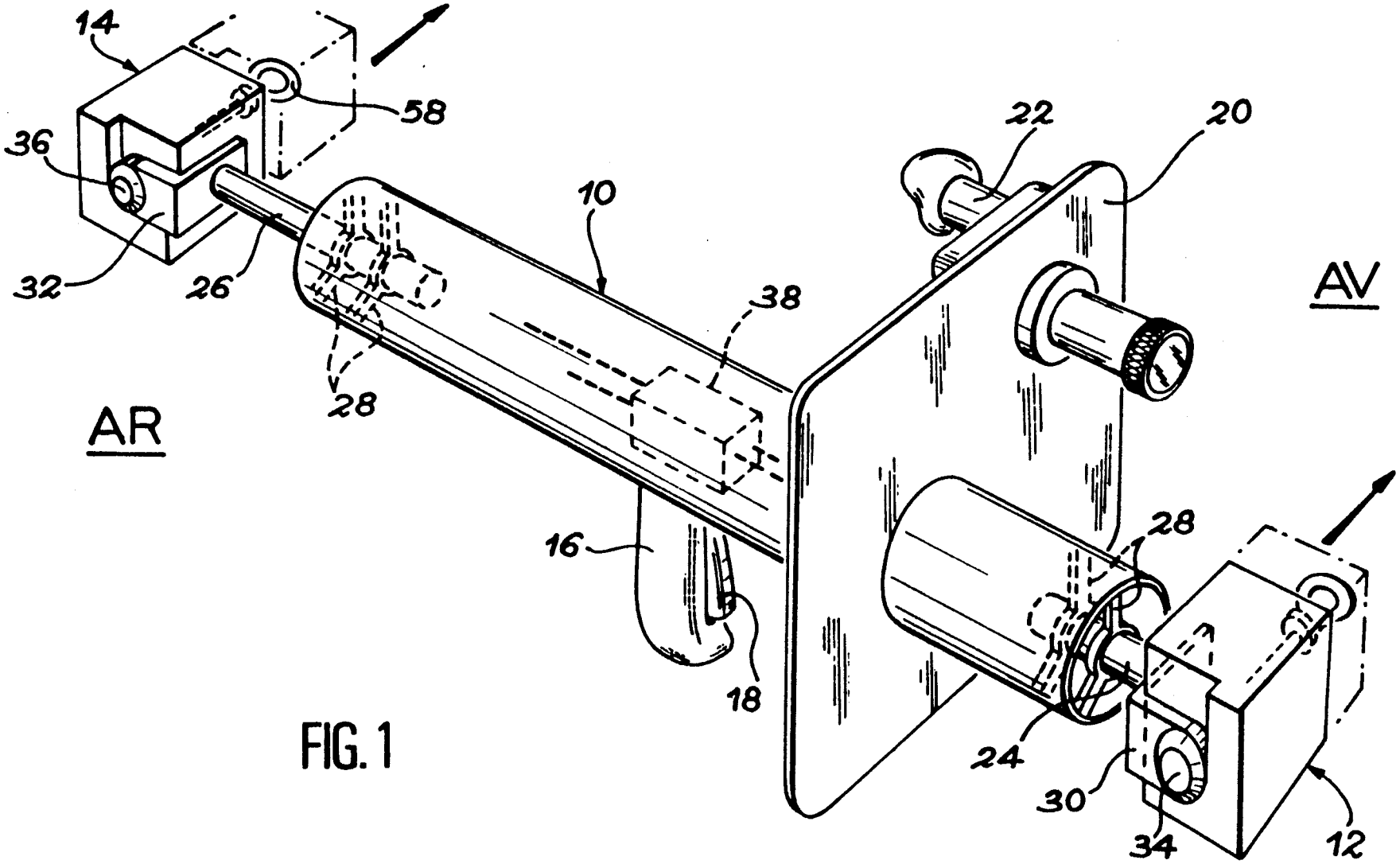

The invention relates to a simulator for training marksmen or firers having to fire missiles from the shoulder.

When a missile is fired from the shoulder, the launch of the missile causes disturbances in the firing system. The success of the firing or launch is largely dependent on the reflex reactions of the firer, when he is subject to these disturbances.

In order to aid firers or marksmen in acquiring correct reactions to such disturbances, for certain firearms consideration has already been given to training the firers on simulators reproducing as faithfully as possible the disturbances suffered by the firer when using his weapon in actual practice. Thus, FR-A-2 354 531 describes a mechanism making it possible to simulate the recoil of a firearm such as a gun.

However, on firing a missile from the shoulder, the disturbances produced by the launch of the missile have various origins and lead to firing system movements which have not hitherto been simulatable.

The disturbances produced by the launch of the missile are due both to the load relief of a considerable part of the mass which the firer had to carry prior to launch, friction of the missile in the tube, forces induced by the missile launcher and forces linked with the remote control wire connecting the missile to its launch tube in the case of a wire-guided missile.

The firing system movements caused by these disturbances can be broken down into angular site and bearing movements. The angular site movements correspond to a pivoting of the launch tube about a horizontal axis level with the firer's shoulder, i.e. upwards or downwards. The angular bearing movements correspond to a pivoting of the launch tube about a vertical axis intersecting the previously mentioned axis, i.e. to the right or left.

The invention proposes a training simulator for firing missiles from the shoulder making it possible to faithfully reproduce these angular site and bearing movements produced by the disturbances suffered by the firing system during missile launch.

According to the invention, this result is obtained by means of a training simulator for firing missiles from the shoulder able to reproduce the disturbances produced in the firing system by the launch of a missile, characterized in that it comprises a simulated launch tube, a front releasable or jettisonable mass and a rear releasable or jettisonable mass respectively mounted at the front and rear ends of the simulator launch tube by front and rear provisional securing means, successive release means for the provisional rear and then the provisional front securing means with a predetermined time lag, front and rear ejection means, respectively associated with the front and rear provisional securing means, in order to laterally eject from the same side the front jettisonable mass and the rear jettisonable mass, during an actuation of the successive release means.

In such a simulator, the front and rear ejection means can in particular be constituted by elastic means such as compression springs occupying a compressed state when the provisional securing means are actuated. These elastic means have rigidities and travels making it possible to reproduce the bearing movement constituting one of the disturbances produced by the launch of the missile.

Moreover, the front jettisonable mass and the rear jettisonable mass have a total mass or weight making it possible to reproduce the load relief of the real launch tube, which is another of the disturbances produced by the launch of the missile.

Moreover, the predetermined time lag between the release of the rear provisional securing means and that of the front provisional securing means, as well as the relative values of the rear jettisonable mass and the front jettisonable mass, make it possible to reproduce the site movement, which constitutes yet another of the disturbances produced by missile launch.

For the simulation to be effective, it is also desirable that the simulated launch tube has a weight and an inertia substantially equal to those of the real launch tube of the firing system following missile launch.

In comparable manner, it is desirable that the simulated launch tube carrying the front jettisonable mass and the rear jettisonable mass forms an assembly having a weight or mass substantially equal to that of the real launch tube of the firing system prior to missile launch.

The invention is described in greater detail hereinafter relative to a non-limitative embodiment and the attached drawings wherein show:

FIG. 1 A perspective view very diagrammatically illustrating a simulator according to the invention.

Figure 2:
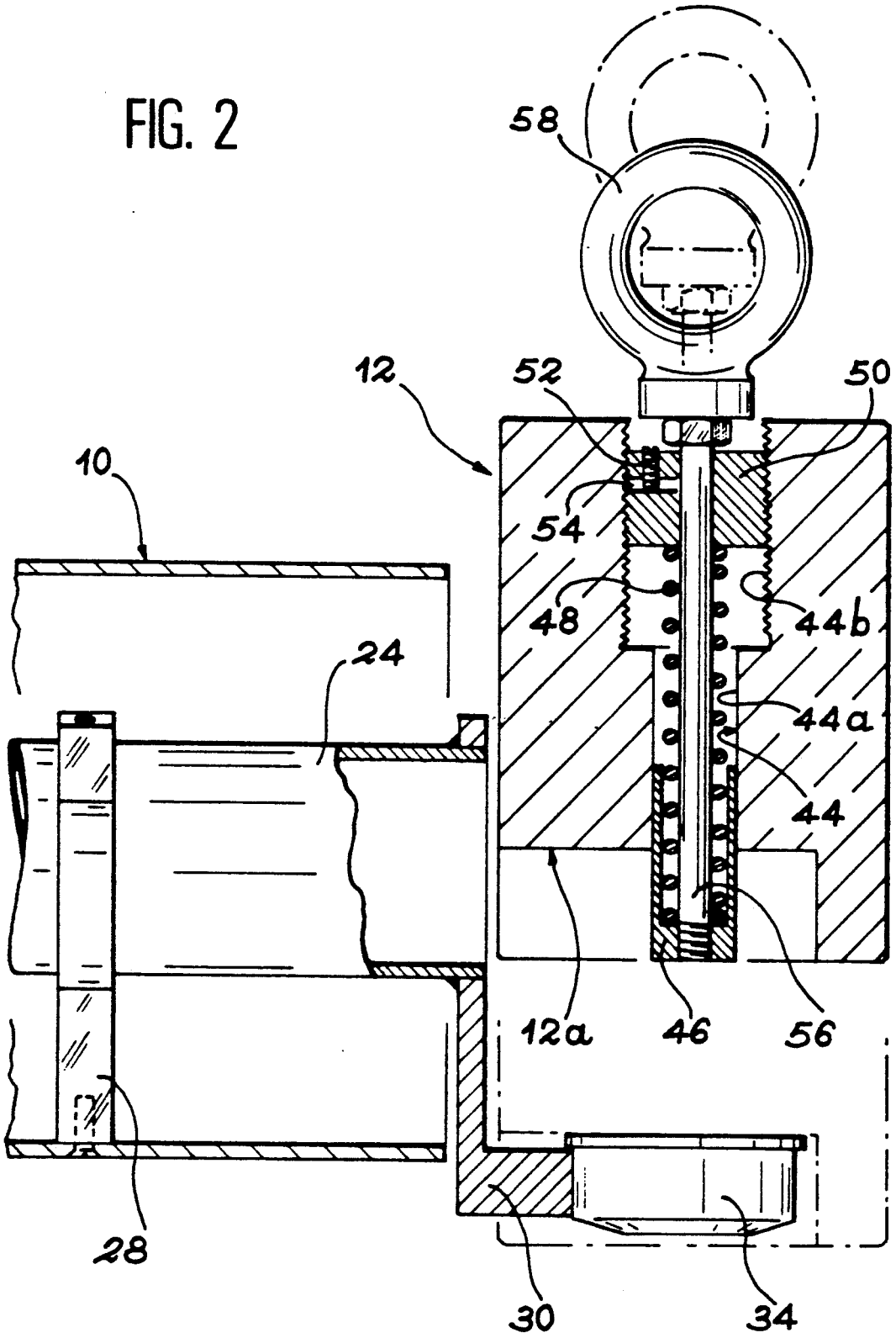

FIG. 2 A sectional view along a horizontal plane illustrating on a larger scale one of the ends of the simulator of FIG. 1.

As is very diagrammatically illustrated in FIG. 1, the training simulator for firing missiles from the shoulder according to the invention essentially comprises a simulated launch tube 10, a front releasable or jettisonable mass 12 and a rear releasable or jettisonable mass 14.

The simulated launch tube 10 has dimensions substantially equal to those of the real launch tube of the firing station, whose use it is wished to simulate. Moreover, the mass and inertia of the simulated launch tube 10 are substantially equal to those of the real launch tube.

In addition, the assembly formed by the simulated launch tube 10 carrying the front jettisonable mass 12 and the rear jettisonable mass 14 has a mass substantially equal to that of the real launch tube prior to missile launch.

These characteristics enable a firer using the simulator according to the invention to feel, prior to the launch of the missile, sensations similar to those which he feels when carrying the real launch tube on his shoulder.

FIG. 1 also shows the grip 16 enabling the firer to hold the simulated launch tube 10, as well as the trigger 18 equipping said grip 16 and whose actuation makes it possible to simulate missile firing.

The simulated launch tube 10 is also equipped with other conventional real firing system accessories, which normally consist of a shield 20 and a sight-tube 22, as illustrated in FIG. 1.

The front jettisonable mass 12 and the rear jettisonable mass 14 are located in the extension of the two ends of the simulated launch tube 10 by support tubes 24 and 26 fixed coaxially to the interior of the simulated launch tube 10 and which project beyond each of the ends of the latter. The fixing of each of the support tubes 24 and 26 in the simulated launch tube 10 is ensured by two braces having three branches 28. Each of these braces is integral with an external ring, which can be locked by screws within the simulated launch tube 10 and an internal ring which can be locked by screws on the corresponding support tube 24 or 26. This arrangement makes it possible to accurately regulate the axial and angular position of each of the support tubes 24, 26 with respect to the simulated launch tube 10.

The end of each of the support tubes 24, 26 positioned outside the simulated launch tube 10 carries an angle bracket 30, 32 on which is respectively mounted an electromagnet 34, 36 constituting a means for provisionally securing the front jettisonable mass 12 and the rear jettisonable mass 14.

Each of the electromagnets 34, 36 can be electrically energized from an electronic box 38, e.g. fitted in the central part of the simulated launch tube 10 by means of two, not shown switches, which are operated with a predetermined time lag $\Delta t$ in order to deenergize each of the electromagnets 34, 36 when the trigger 18 is actuated. More specifically, by means of switches, the electronic box 38 makes it possible to successively deenergize the rear electromagnet 36 and then the front electromagnet 34 with the predetermined lag $\Delta t$. The trigger 18, the electronic circuit 38 and the associated switches, thus constitute the successive release means for the electromagnets 34, 36.

When the simulator according to the invention is placed on the shoulder of a person undergoing firing training, the jettisoning of the rear jettisonable mass 14 and then the front jettisonable mass 12 after the time lag $\Delta t$ produces on the simulator an angular site movement, i.e. a rotary movement about a horizontal axis passing over the firer's shoulder. Firstly this movement pivots the simulator downwards following the jettisoning of the rear mass 14 and then upwards after the jettisoning of the front mass 12. Thus, the angular site movements produced on the real firing system during missile launch are reproduced.

The simulator according to the invention also has front and rear ejection means respectively associated with the electromagnets 34 and 36, in order to laterally eject to the left of the simulator the rear jettisonable mass 14 and then the front jettisonable mass 12, when the electromagnets 36 and then 34 are deenergized.

The lateral ejection of the rear jettisonable mass 14 and then the front jettisonable mass 12 has the effect of reproducing on the simulator angular bearing movements, which are produced on a real firing system during the launch of a missile. More specifically, the ejection to the left of the rear jettisonable mass 14 firstly has the effect of pivoting to the left the simulator about a vertical axis passing through the shoulder of the firer. Then, the ejection in the same direction of the front jettisonable mass 12 has the effect of pivoting the simulator to the right about the aforementioned vertical axis.

When the trainee firer presses the trigger 18, the release and ejection successively of the rear jettisonable mass 14 and the front jettisonable mass 12 consequently make it possible to give said firer sensations like those which he will feel during a real firing from the shoulder. Thus, the jettisoning of the rear jettisonable mass 14 and the front jettisonable mass 12 makes it possible to reproduce the load relief of the real launch tube felt by the firer during the launch of a missile. The time lag $\Delta t$ between the jettisoning of the rear mass 14 and the jettisoning of the front mass 12 makes it possible to reproduce the angular site movements felt by the firer during a real launch. Then, the lateral ejection, which is also time-displaced, of the rear and front jettisonable masses produces the angular bearing movements felt by the firer during a real launch.

With reference to FIG. 2, a more detailed description will now be given of the means for ejecting the front jettisonable mass 12. It should be noted that the means for ejecting the rear jettisonable mass 14 are like the front mass ejection means, so that they will not be separately described.

The mass 12 is generally shaped like a rectangular parallelepiped and is made from a metal block. One of the faces of said parallelepiped, which is oriented laterally to the right when the mass 12 is fixed to the front end of the simulated launch tube 10, has a recess **12*a*, which is normally penetrated by the electromagnet 34. A staged bore 44, transversely traversing the front jettisonable mass 12 issues into the bottom of the recess 12*a***.

A tubular bush 46 is slidingly received in a smaller diameter part **44*a* of the bore 44 located on the side of the recess 12*a*. On the side of the recess 12*a*, said bush 46 has a bottom against which bears the end of a helical compression spring 48. This helical compression spring 48, which constitutes the front ejection means of the simulator, is located in the bore 44 and bears by its opposite end on a nut 50 screwed into a larger diameter threaded part 44*b* of the bore 44 issuing onto the face of the mass 12 opposite to the recess 12*a*. The varyingly deep screwing of the nut 50 into the threaded part of the bore 44 makes it possible to regulate, as desired, the compression of the spring 48 prior to the fitting of the front jettisonable mass 12 at the corresponding end of the simulated launch tube 10**.

In the embodiment illustrated in FIG. 2, the locking of the nut 50 in the desired position is ensured by means of a grub screw 52, screwed parallel to its axis into the nut 50, from the end of the bore 44 issuing onto the face of the mass 12 opposite to the recess **12*a*. The end of the grub screw 52 bears on the corresponding face of a slot 54 formed radially in the nut 50**.

In order to permit the transport of the front jettisonable mass 12 and the compression of the spring 48 during the installation of said mass at the corresponding end of the simulated launch tube 10, a rod 56 carrying a ring 58 at one of its ends axially traverses the bore 44, the nut 50 and the spring 48, to be fixed by its opposite end to the bush 46, e.g. by screwing and bonding.

When the electromagnet 34 is energized, the front jettisonable mass 12 is put into place on the angle bracket 30, in such a way that the electromagnet 34 is placed in the recess **12*a*. The bush 46 is then forced back, so that its bottom is flush with the bottom of the recess 12*a*. Thus, the spring 48 is compressed by the desired amount, determined by the screwing of the nut 50 into the threaded part of the bore 44. In order to carry out this placing of the mass 12 on the angle bracket 30, the operator makes use of the ring 58 in order to flush engage the bush 46 within the bore 44. The installation of the rear jettisonable mass 14 at the other end of the launch tube 10** takes place in exactly the same way.

As soon as the firer operates the simulator trigger 18, the electronic box 38 controls the opening of the switch associated with the electromagnet 36, so that the latter stops being energized. The compression spring 48 installed in the rear jettisonable mass 14 is then released and automatically ejects said mass to the left in FIG. 1. The same effect is then obtained, with a time lag $\Delta t$, on the front jettisonable mass 12. Thus, as described, on the simulator are produced the disturbances which normally occur on a firing system as a result of a missile launch.

In practice, disturbances produced on a shoulder firing system vary between individual systems. In order that the simulator according to the invention reproduces as faithfully as possible the said disturbances, for each weapon type in question a certain number of tests is carried out on real firearms, in order to measure the variations in time of the angular site and bearing movements of the real launch tube. On the basis of these measurements, an empirical determination takes place of a certain number of characteristics of the simulator such as the predetermined lag Δt between release of the rear jettisonable mass 14 and the front jettisonable mass 12, the distribution of a total mass equivalent to the mass of the missile between these two masses and the distance separating each of the jettisonable masses 12 and 14 from the location where the simulator launch tube rests on the firer's shoulder. Moreover, a measurement also takes place of the inertia of the real firing system having the real launch tube.

On the basis of the aforementioned information and in particular the values of the ejected masses, the inertia of the firing system and the predetermined lag Δt, a conventional mechanical calculation makes it possible to determine the characteristics of the springs (rigidity and travel) by means of which the angular bearing movements empirically observed on the real firing system can be reproduced.

For example, in the case of a real 17 kg firing system, for which a missile launch corresponds to a load relief of 10.7 kg, the measurements and tests carried out on this firing system led to the choice of a predetermined time lag Δt of approximately 0.052 s, a rear mass of 4.580 kg placed at 0.65 m from the firer's shoulder, a front mass of 5.425 kg placed at 0.60 m from the same location, a front spring having a rigidity of 13.04N/mm and a compression of 16 mm and a rear spring having a rigidity of 2.73N/mm and a compression of 24 mm.

Obviously, the invention is not limited to the embodiment described in exemplified manner hereinbefore and covers all variants thereof. Thus, the provisional securing means of the front and rear masses at the end of the simulated launch tube and constituted by electromagnets in the embodiment described, could be replaced by technically equivalent, e.g. mechanical securing means without passing outside the scope of the invention. In a comparable way, the compression springs making it possible to eject the front and rear masses in the embodiment described could be replaced by any other elastic system making it possible to laterally eject the masses in question.

We claim:

1. A training simulator for firing missiles from the shoulder able to reproduce the disturbances produced in the firing system by the launch of a missile, comprising a simulated launch tube, a front releasable or jettisonable mass and a rear releasable or jettisonable mass respectively mounted at the front and rear ends of the simulator launch tube by front and rear provisional securing means, successive release means for the provisional rear and then the provisional front securing means with a predetermined time lag Δt, front and rear ejection means, respectively associated with the front and rear provisional securing means, in order to laterally eject from the same side the front jettisonable mass and the rear jettisonable mass, during an actuation of the successive release means.

2. A simulator according to claim 1, wherein the front and rear ejection means comprise a front elastic means and a rear elastic means occupying a compressed state when the provisional front and rear securing means are actuated.

3. A simulator according to claim 2, wherein the front elastic means and the rear elastic means have rigidities and travels making it possible to reproduce a bearing movement constituting one of the said disturbances.

4. A simulator according to claim 1, wherein the simulated launch tube has a mass and an inertia substantially equal to those of a real launch tube of the firing system following the launch of a missile.

5. A simulator according to claim 1, wherein the simulated launch tube carrying the front jettisonable mass and the rear jettisonable mass forms an assembly having a mass substantially equal to that of a real launch tube of the firing station prior to the launch of a missile.

6. A simulator according to claim 1, wherein the rear jettisonable mass and the front jettisonable mass have a total mass making it possible to reproduce a load relief of the real launch tube during the launch of the missile, constituting one of the said disturbances.

7. A simulator according to claim 1, wherein said predetermined time lag Δt and the relative values of the jettisonable rear mass and the jettisonable front mass make it possible to reproduce a site movement constituting one of the said disturbances.

8. A simulator according to claim 1, wherein the front and rear provisional securing means comprise electromagnets.

* * * * *